US007124905B2

(12) United States Patent
Granger et al.

(10) Patent No.: US 7,124,905 B2
(45) Date of Patent: Oct. 24, 2006

(54) CLOSURE CAP FOR A STANDARD GLASS RING

(75) Inventors: Jacques Granger, Sainte Terre (FR); Jean-Marie Bourreau, Le Pizou (FR)

(73) Assignee: Pechiney Emballage Alimentaire, Clichy (FR)

( * ) Notice: Subject to any disclaimer, the term of this patent is extended or adjusted under 35 U.S.C. 154(b) by 39 days.

(21) Appl. No.: 10/169,069

(22) PCT Filed: Jan. 3, 2001

(86) PCT No.: PCT/FR01/00011

§ 371 (c)(1),
(2), (4) Date: Jul. 31, 2002

(87) PCT Pub. No.: WO01/51381

PCT Pub. Date: Jul. 19, 2001

(65) Prior Publication Data

US 2003/0021919 A1 Jan. 30, 2003

(30) Foreign Application Priority Data

Jan. 13, 2000 (FR) ..... 00 00397

(51) Int. Cl.
*B65D 41/04* (2006.01)

(52) U.S. Cl. ..... 215/329; 215/274; 222/571

(58) Field of Classification Search ..... 215/329, 215/334, 274–276, 22, 18; 222/500, 571, 222/568

See application file for complete search history.

(56) References Cited

U.S. PATENT DOCUMENTS 2,009,666 A * 7/1935 Keith ..... 215/334
2,061,603 A * 11/1936 Ward et al. ..... 215/21
2,744,647 A * 5/1956 Wheaton et al. ..... 215/334
3,215,297 A 11/1965 Acton et al.
3,371,813 A * 3/1968 Owen et al. ..... 215/318
3,532,243 A * 10/1970 Acton et al. ..... 215/334
3,587,898 A * 6/1971 Norhtup ..... 215/252
4,000,825 A * 1/1977 Westfall ..... 215/318
4,256,234 A 3/1981 Mori et al.
4,520,938 A * 6/1985 Finke ..... 215/220
4,562,930 A * 1/1986 Lecinski et al. ..... 215/44
4,576,299 A * 3/1986 Lecinski, Jr. ..... 215/318
4,597,501 A * 7/1986 Gueret ..... 215/330
4,779,749 A 10/1988 Geiger
5,103,991 A * 4/1992 Collins ..... 215/329
5,143,236 A * 9/1992 Gueret ..... 215/311
5,197,619 A * 3/1993 Margaria ..... 215/256
5,238,130 A 8/1993 Marques et al.
5,255,805 A * 10/1993 Weiss et al. ..... 215/274
5,924,606 A * 7/1999 Huizing ..... 222/500
5,971,179 A * 10/1999 Christmas et al. ..... 215/21
5,984,123 A * 11/1999 Mogami et al. ..... 215/235

(Continued)

FOREIGN PATENT DOCUMENTS

GB 1088527 10/1967

(Continued)

*Primary Examiner*—Lien M. Ngo
(74) *Attorney, Agent, or Firm*—Dennison, Schultz & MacDonald

(57) ABSTRACT

Closing cap (1) for a receptacle, typically a bottle with a threaded neck comprising an outer cap (2) typically provided with a top (20) and a skirt (21), and an insert (3) made of a plastic material with a threaded skirt (31) fixed to the said outer cap (2), characterised in that the said threaded skirt (31) comprises an inner thread (32), and the thickness of the bottom (320) varies from 0.40 mm to 0.150 mm.

16 Claims, 6 Drawing Sheets

U.S. PATENT DOCUMENTS

| | | | | |
|---|---|---|---|---|
| 6,102,227 | A * | 8/2000 | Cochrane | 215/256 |
| 6,276,544 | B1 * | 8/2001 | Battegazzore | 215/252 |
| 6,357,614 | B1 * | 3/2002 | Kerr | 215/21 |
| 6,403,173 | B1 | 6/2002 | Granger et al. | |
| 6,619,492 | B1 * | 9/2003 | Battegazzore | 215/21 |

FOREIGN PATENT DOCUMENTS

| | | | | |
|---|---|---|---|---|
| WO | 98/52833 | | 11/1998 | |
| WO | WO 01/26990 | * | 4/2001 | 215/21 |

* cited by examiner

CLOSURE CAP FOR A STANDARD GLASS RING

This application is a filing under 35 USC 371 of PCT/FR2001/00011, Jan. 3, 2001.

FIELD OF THE INVENTION

The invention relates to the domain of caps and particularly screw closing caps to close receptacles or bottles with a glass neck or ring on which a thread is formed.

These bottles are typically used to contain aperitifs, alcoholic liquors, alcohol or alcoholised drinks, that are typically consumed only occasionally, so that the said bottles need to be closed and opened possibly very many times.

These caps usually include a tamper-proof or guarantee strip.

DESCRIPTION OF RELATED ART

Many different caps are already known.

Some of these caps are made of plastic, like those described in European patent No. 0107 680 issued by the applicant, and typically used to close plastic water bottles.

Others are metallic, like those described in French patent application number 9705182 or 9706009 in the name of the applicant, and typically used for closing bottles containing alcohols, aperitifs and spirits. These caps include a threaded plastic insert.

Screw caps for closing bottles containing aperitifs, alcohols and spirits include a threaded plastic insert fixed on the inside of a typically metallic outer cap, so that there is no thread visible on the outside.

A first problem that arises with caps according to the state of the art is the need to use receptacles, typically bottles, with an expensive glass ring since it is specifically adapted to this type of cap. These caps are known under the trade name Supaluxe® and therefore there is a specific glass ring standard for these caps.

A second problem is the cost of the insert, and particularly the cost of the material used for the insert.

The plastic insert in caps according to the state of the art has a given thickness which requires the development of a special glass ring.

The purpose of the invention is a cap with an insert with a thin skirt so that standard glass rings can be used and to reduce the cost of the insert material and the bottle.

SUMMARY OF THE INVENTION

According to the invention, the cap comprises an outer cap, typically with a top and a skirt, and a plastic insert with a threaded skirt fixed to the said outer cap, and is characterised in that the said threaded skirt comprises an inner thread with a bottom thickness varying from 0.40 mm to 0.150 mm.

Preferably, the said thickness varies from 0.25 mm to 0.20 mm.

In caps according to the invention, the ratio between the thickness of the thread at the top and at the bottom is between 2 and 10.

It is preferably between 5 and 9.

Inserts according to the invention may be between 10 mm and 20 mm high.

A typical insert according to the invention has a skirt height of between 12 and 14 mm, the thickness of the bottom of the thread in the skirt of the said insert being between 0.15 and 0.30 mm, and the weight typically being between 0.8 and 1.5 g, these properties corresponding to a standard glass ring according to French standard NF H35-103 with a diameter typically between 30 and 31.5 mm for the most frequent diameters, or any other ISO, CEN or AFNOR standard for a screw ring made of glass or any plastic material on which a cap can be fitted.

The cap according to the invention is characterised by the fact that the insert has a very thin skirt, so that all the problems of the invention can be solved simultaneously.

By comparison, inserts according to the state of the art have the following characteristics:

thickness at bottom of thread: 3 mm, thickness at top of thread: 4 mm, skirt height: 25 mm, weight: from 4 to 5 g.

A simple comparison of these data shows the enormous difference between the inserts according to the state of the art and according to the invention.

Subsequent to her tests and work, the applicant has observed that provided that adaptations are made and unlike what she believed initially, it is possible to:

mold an insert with a thin skirt, at least within some limits, manipulate and assemble inserts in line, even if they are very lightweight, using outer caps, obtain a final cap that operates correctly on a standard glass ring, both for screwing and for leak tightness, provided that the said insert and the said outer cap are well fixed together.

The applicant has observed that with inserts according to the invention, unlike inserts according to the state of the art, the insert alone does not have sufficient high mechanical properties to enable screwing and for leak tightness. On the other hand, the applicant observed that an insert according to the invention, even with a very thin skirt and with very weak mechanical properties in itself, can fulfil the expected functions particularly for screwing and leak tightness provided that it is fixed to an outer cap, or at least to a skirt with the required mechanical properties.

In caps according to the state of the art, the insert considered as being an entity was fixed in rotation to the outer cap, since it was necessary for the manual screwing or unscrewing force applied to the outer cap to be transmitted to the inner cap.

Therefore, with inserts according to the invention, the applicant found that it is sufficient if the insert keeps a sufficiently thick thread (typically of the order of 1 mm) and a thin skirt (typically 0.2 mm), but just sufficiently thick to enable formation of the said insert and for handling it. Therefore, the applicant found that the thread could perform its technical functions simply provided that it is fixed to an outer cap with sufficiently high mechanical properties, the thin skirt being used for fabrication and handling of the insert and only making a secondary contribution to the mechanical resistance of the thread, being therefore virtually no longer necessary.

With its weight divided by 4 or 5 and the thickness at the bottom of the thread being more than 10 times less than the thickness of an insert according to the state of the art, inserts according to the invention are not an improvement to known inserts, they actually form a new generation of inserts.

These inserts were developed following exploratory tests made without any real expectation of success, since they are outside the range considered as being realistic by an expert in the subject considering foreseeable problems of forming inserts with such a thin skirt by injection, or assembling such lightweight inserts, or obtaining the same usage properties as are possible with inserts according to the state of the art.

BRIEF DESCRIPTION OF THE DRAWINGS

FIG. 2*a* is a variation of the cap shown in FIG. 2, in which the threads are discontinuous.

FIG. 6 shows an anti-drip device (6) pre-assembled with the said cap through the said lip (33), and during capping fixed to the inside of the glass ring (51) around the neck (5) through attachment ribs (60), whereas in FIG. 7 the cap comprises a refill prevention device (7), typically similar to the anti-drip device (6) but typically containing a bail (70) between a lower lip (72) preventing the ball from falling out and preventing subsequent refilling of the receptacle or the bottle, and between an upper membrane (71) preventing extraction of the ball (70) while allowing the liquid contained in the bottle to flow.

FIG. 9*a* is a bottom view of the cap and mandrel of FIG. 9.

DETAILED DESCRIPTION OF THE INVENTION

According to the invention, the skirt (31) of the said insert (3) is fixed to the skirt (21) of the said outer cap (2) by gluing, typically using a layer of adhesive, by force fitting or by heat sealing.

Glue is used in preference. This glue may be obtained either by using a layer of adhesive forming the bond between the said insert and the said outer cap, typically a layer of adhesive that is applied hot known as "hot-melt", or using an outer cap with an inside surface on which the said insert can be bonded. Thus, as described in French application No. 9706009 in the name of the applicant, an outer cap coated on the inside with a layer comprising plastic material forming the said insert in the divided state and that can thus be heat sealed to the said insert, can be used.

Figure 5:
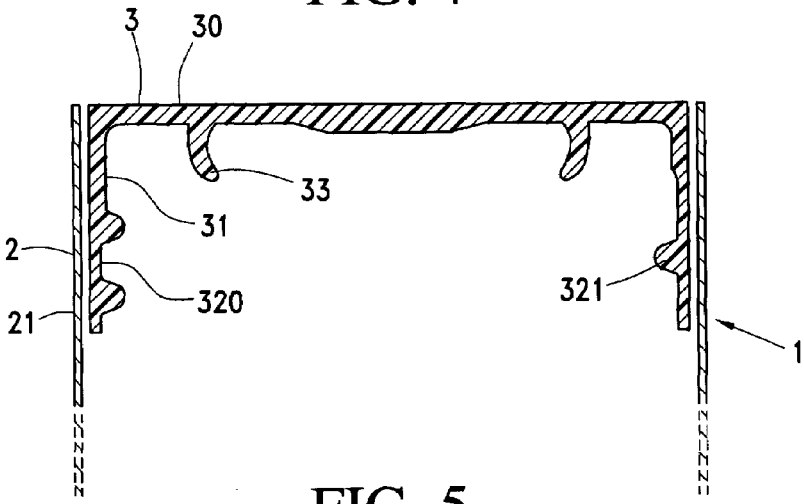
FIG. 5, similar to FIG. 4, shows a cap in which the top of the insert is fitted with a sealing lip that replaces the add-in seal in the caps in the previous figures.

According to one embodiment of the invention shown in FIG. 5, the said insert (3) may comprise a top (30) typically provided with an inner lip (33) to make the cap leak tight.

Figure 1:
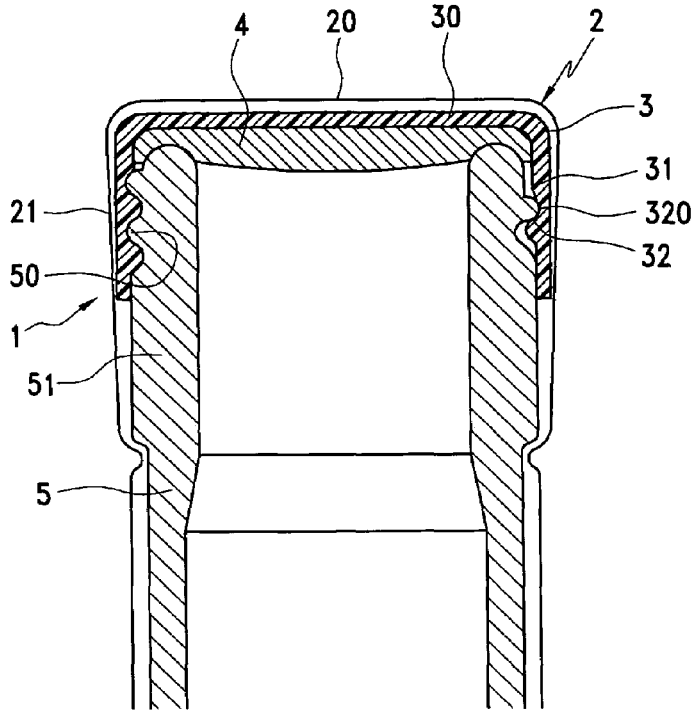
FIG. 1 shows an axial cross-section through a cap (1) according to the invention crimped onto a standard glass ring and fitted with an add-in leak tightness seal (4). For reasons of clarity, the outer cap (2) and the insert (3) are presented with a space between them, whereas they are actually firmly fixed together. The same is true in the following figures.
Figure 2:
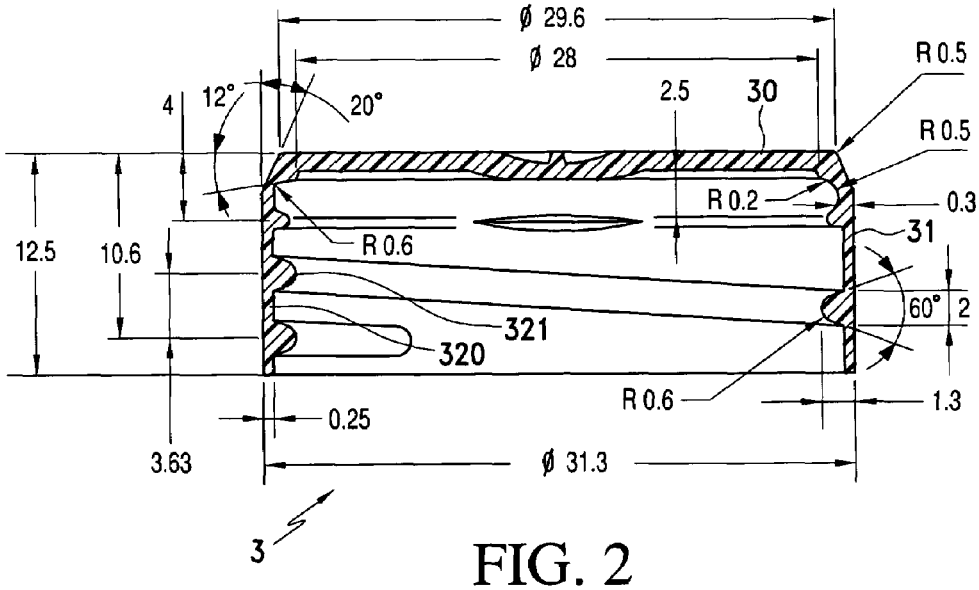
FIG. 2 is an axial sectional view of the insert for the cap in FIG. 1.
Figure 3:
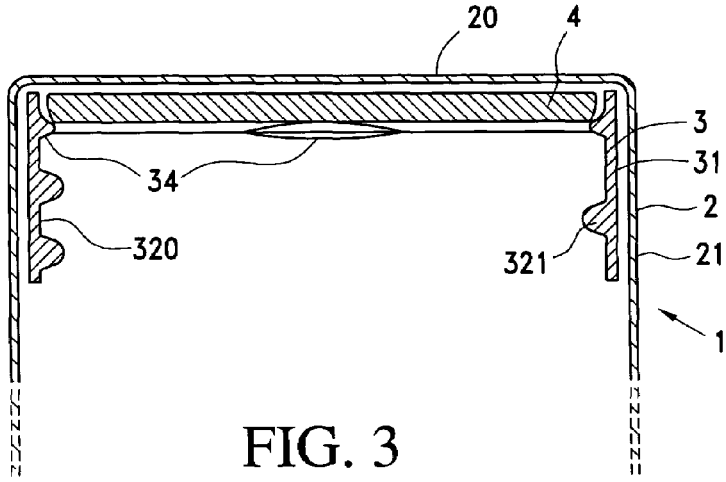
FIG. 3 is a partial axial sectional view of a cap according to the invention similar to that in FIG. 1, in which the said insert is composed of a skirt.

But as shown in FIGS. 1 to 4, an add-in seal (4) integrated in the cap and held in place at the bottom of the cap by a rib (34), can keep the cap leak tight. In this case, the said insert (3) may be composed simply of a threaded skirt (31) as shown in FIG. 3.

Figure 6:
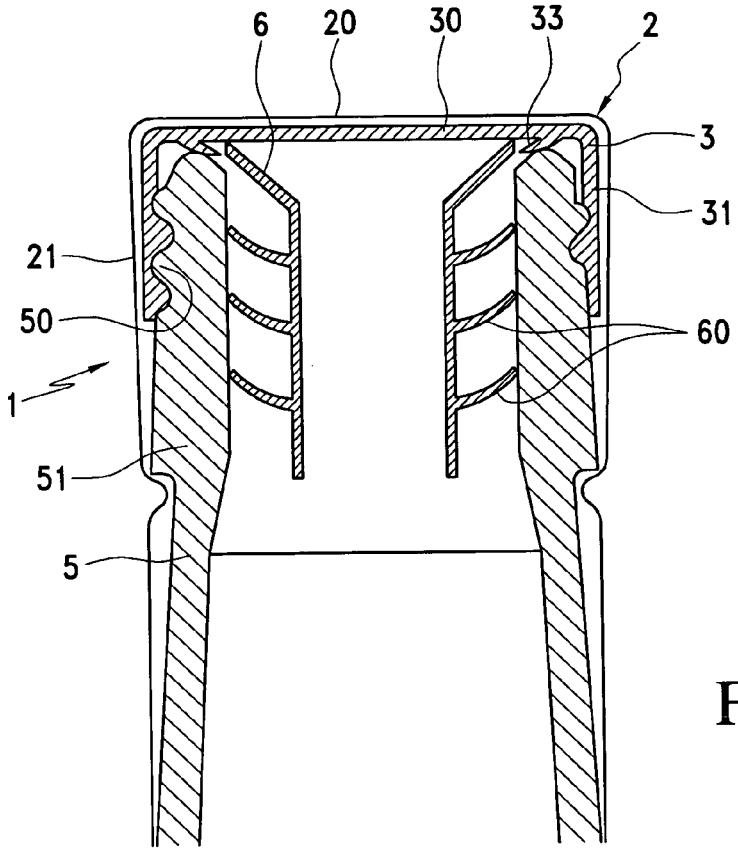
FIGS. 6 and 7, similar to FIG. 1, show a cap (1) provided with a sealing lip (33) instead of the add-in seal (4) in FIG. 1.
Figure 6A:
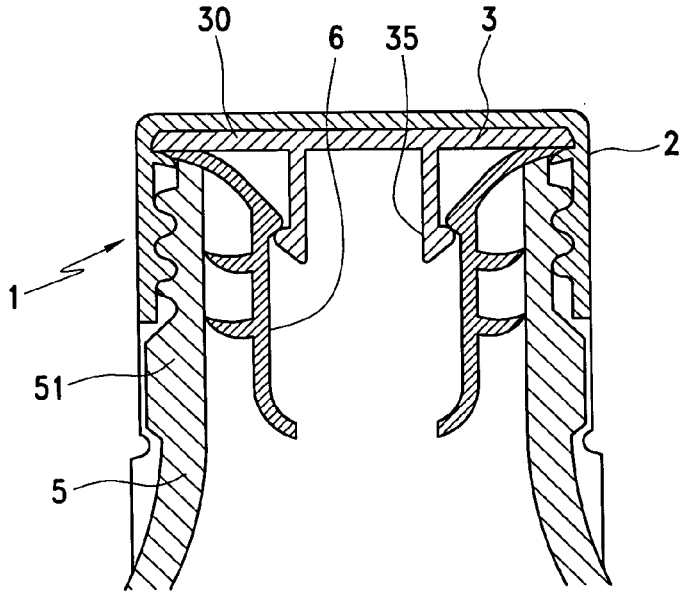
In FIGS. 6*a* and 7*a*, similar to FIGS. 6 and 7, the inserts are provided with a closer (35).
Figure 7:
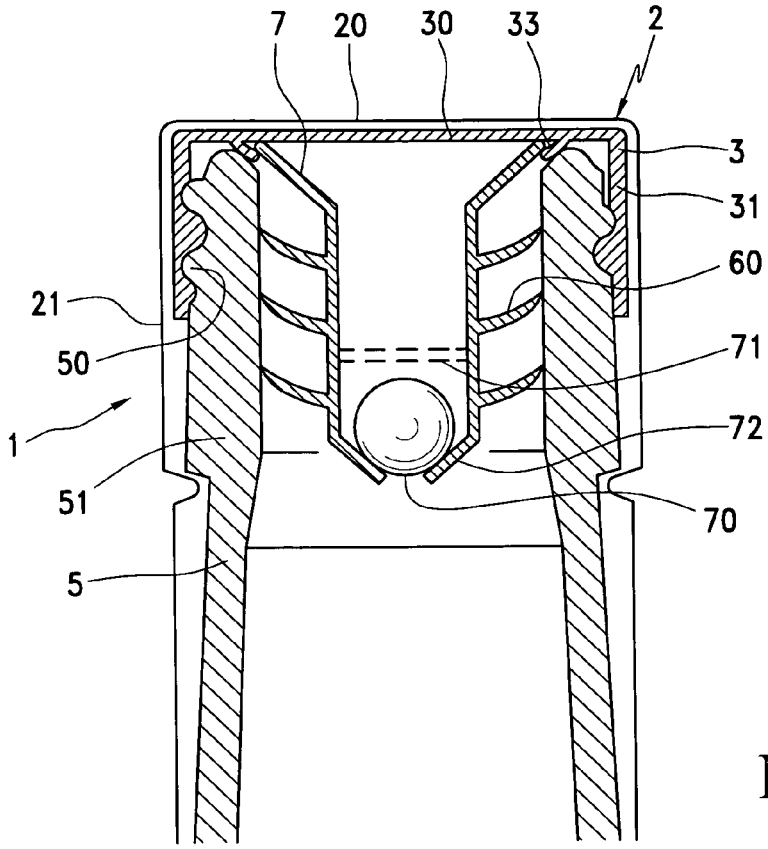
Figure 7A:
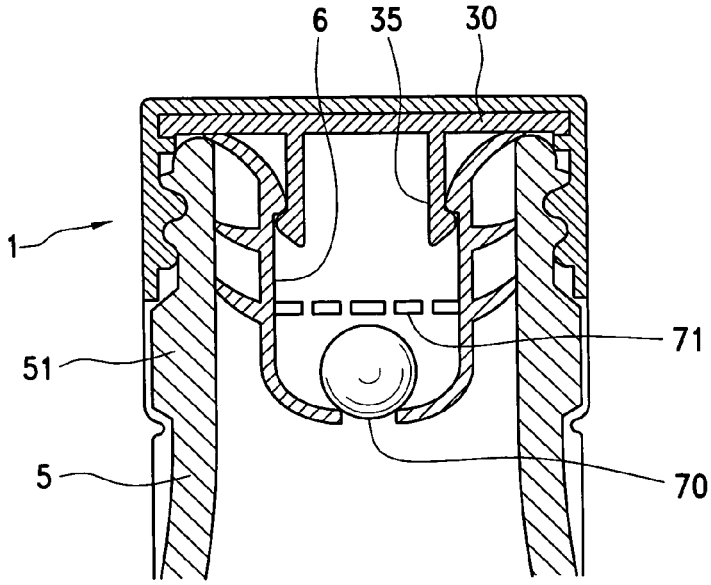
Figure 8:
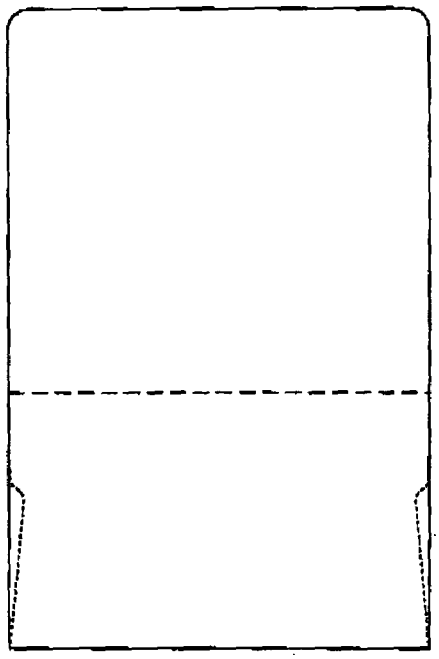
FIG. 8 is a side view of a cap with a line of weakness.
Figure 8A:
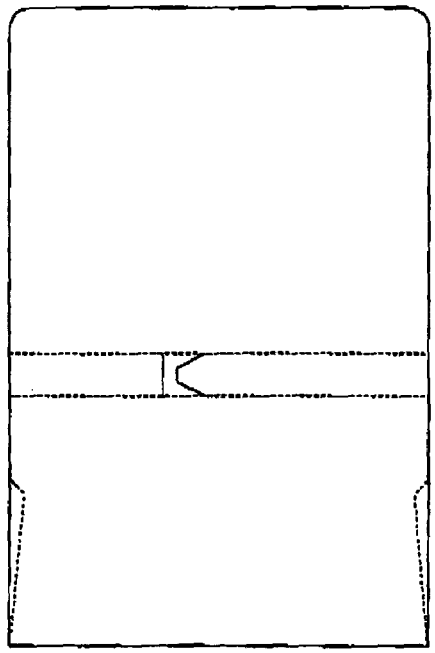
FIG. 8*a* is a side view of a cap with an opening tongue.

As illustrated in FIGS. 6*a* and 7*a*, the insert may comprise a closer (35).

According to the invention, the said outer cap (2) may be chosen from among metallic outer caps, typically made of aluminium, or metallo-plastic outer caps made of a multi-layer material, or outer caps formed by stamping or rolling the corresponding material in the form of a strip and that can be crimped under the mating ring on the neck. The mechanical properties of these outer caps must in particular be sufficient so that the cap can be crimped and to resist radial or axial forces exerted on the insert when screwing and unscrewing the cap. Typically, the thicknesses of these outer caps can vary from 100 μm to 300 μm depending on the inherent mechanical properties of the materials used.

Figure 4:
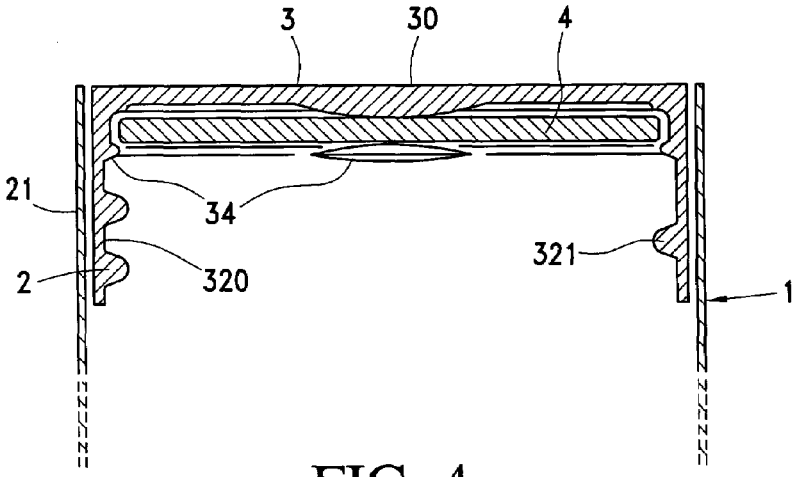
FIG. 4 is a partial axial sectional view of a cap according to the invention similar to that in FIG. 1, in which the said outer cap is composed of a skirt.
Figure 4A:
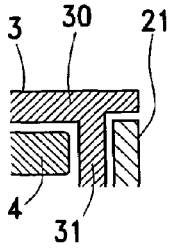
FIG. 4*a* is a method of assembly of a cap according to FIG. 4.

The said outer cap (2) may be composed of a skirt (21) as illustrated in FIGS. 4 and 4*a*.

It is important that the said insert (3) should be formed of a plastic material that can be injection moulded, is suitable for coming into contact with food, and that it has mechanical properties and particularly a hardness equal to at least the properties of PE at 25° C.

PE, or mixes of PE, PP and any material that satisfies the required properties can also be used, if they form part of less expensive plastics, or PET or PBT can be used.

Preferably, the said plastic material is a polyolefin comprising a mineral filler to improve the mechanical properties of the said plastic material. The percentage of the said filler by weight in the said plastic material can vary from 5 to 50%.

Thus, the said plastic material may be PP and the said percentage by weight may be between 35 and 45%. Talc, typically micronised, can be used as a mineral filler. Thus for example, with 40% talc, a modulus of elasticity in bending of 4490 MPa is obtained. But other mineral fillers such as phyllosilicates could be used.

Furthermore, according to an embodiment of the invention, the threaded skirt of the insert, like the thread of the neck, may be discontinuous in the axial plane such that the attachment of the cap to the threaded neck, the so-called capping operation, can be done by applying simple axial pressure without the need to screw the cap onto the threaded neck.

Furthermore, the cap (1) according to the invention may comprise means of performing one or several of the following complementary functions:

indication of first opening, with a weakening line, easy opening, with an opening tab, refill prevention, with an ad hoc device, as shown in FIGS. 7 and 7*a*, that can be removed or pre-assembled in the insert at the position of the seal to be inserted in the neck when the cap is being fitted, the refill prevention device being said to be "in bore", anti-run, with an anti-drip spout, as shown in FIGS. 6 and 6*a*, that can be removed or pre-assembled in the insert at the position of the seal, to be inserted in the neck when the cap is being fitted.

Another purpose of the invention is a process for manufacturing caps (1) according to the invention. In this process:

a) outer caps (2) are supplied, b) the said inserts (3) are formed by moulding, c) the inserts (3) are assembled in the outer caps (2) to form the said caps (1), typically using a hot-melt layer, d) other elements that may be present in the cap, such as an add-in seal (4), a refill prevention device or an anti-run device are assembled, typically with the said insert.

Preferably, a mandrel with an expandable core is used so that it can be extracted from the mould without unscrewing.

Figure 9:
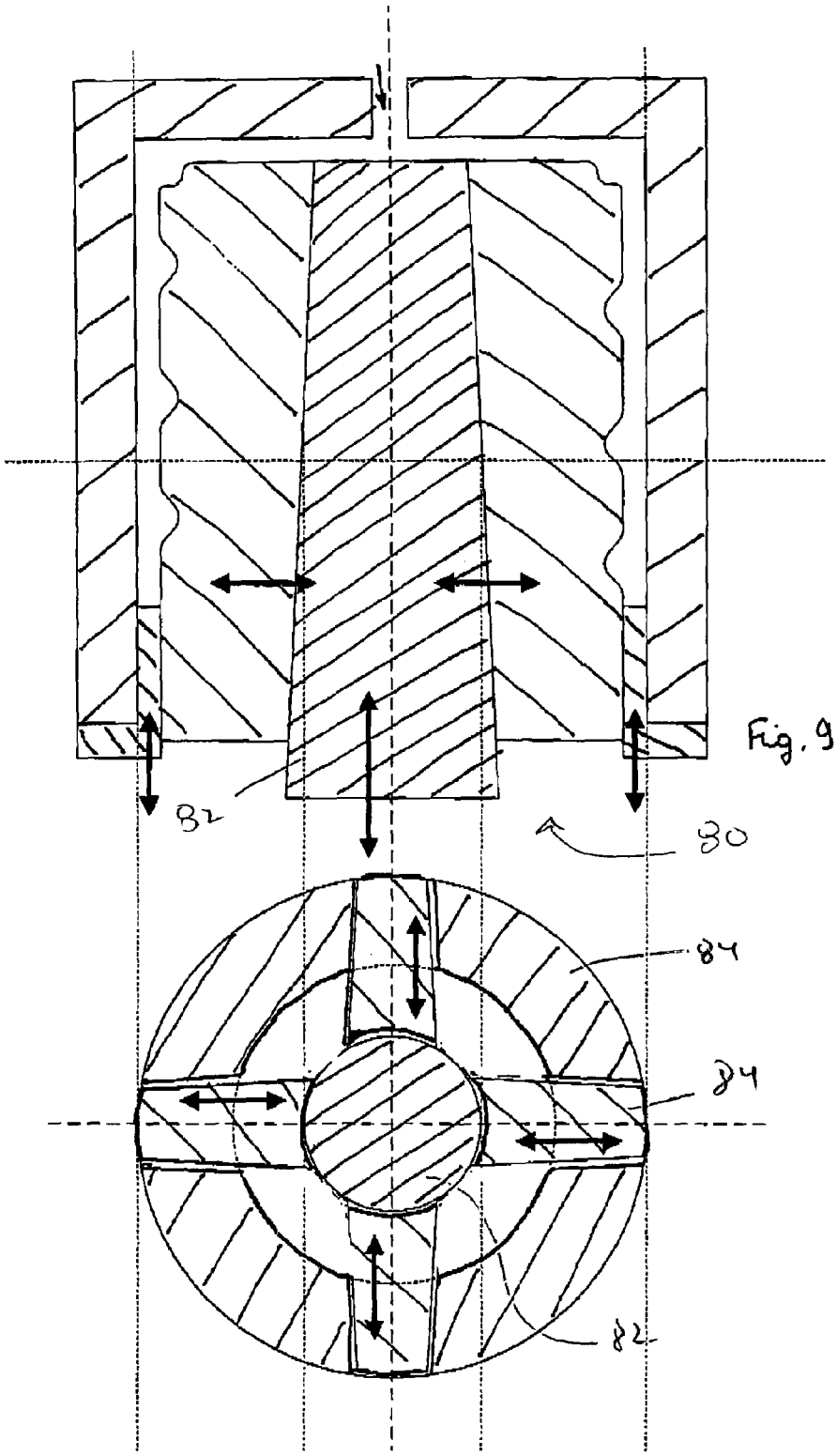
FIG. 9 is a side cross-sectional view of a cap with an expandable mandrel therein.

This arrangement is shown in FIGS. 9 and 9*a*, in which the mandrel includes an expandable core 80 including a central conical pin 82 which pushes on external parts 84 to press the insert into the mold, and then retracts to release the mandrel from the mold.

Outer caps may be formed by stamping or by rolling and by lateral welding of materials in strips or in sheets with the required thickness and structure.

EXAMPLE EMBODIMENTS

Caps are made according to FIGS. 1 to 5.

The inserts (3) are formed by injection moulding of a mix of LDPE and HDPE 50/50 by weight.

Inserts were also moulded from a PP and PET copolymer, and also from PP with a 40% content of talc, as a thermoplastic moulding material.

Inserts (3) according to the invention have been made with standard equipment, without needing to unscrew the central mandrel from the mould, but it has been observed that the production quality is more regular if an expandable mandrel is used to prevent any risk of damage to the inner thread (32) of the insert when the insert (3) is withdrawn from the mould.

All inserts (3) are provided with a skirt (31), the dimensions of which are shown in FIG. 2.

A 0.21 mm thick and 60 mm high aluminium alloy outer cap (2) was used.

A hot-melt type adhesive was used to fix the inserts to the outer caps.

A standard commercially available add-in seal (4) was used.

The different elements were assembled in line as follows:

a hot-melt adhesive was added onto the skirt (21) of the aluminium outer caps (2), the insert (3) was then fixed in the outer cap (2), the add-in seal (4) was then inserted.

Tests carried out on standard bottles with a neck or glass ring (5) were fully satisfactory.

In general, the cap (1) according to the invention has two advantages, since it is more economic than a standard cap and it can also be used on standard bottles.

List of marks in figures

- Closing cap . . . 1
- Outer cap . . . 2
  - Top . . . 20
  - Skirt . . . 21
- Plastic insert . . . 3
  - Top . . . 30
  - Threaded skirt . . . 31
  - Thread . . . 32
    - Bottom of thread . . . 320
    - Top of thread . . . 321
  - Sealing lip . . . 33
  - Support rib . . . 34
  - Closer . . . 35
- Add-in seal . . . 4
- Bottle neck . . . 5
  - Ring thread . . . 50
  - Mating-ring . . . 51
- Anti-drip device . . . 6
  - Attachment ribs . . . 60
- Refill prevention device . . . 7
  - Ball . . . 70
  - Upper membrane . . . 71
  - Lower lip . . . 72

The invention claimed is:

1. Closing cap for a bottle with a threaded neck, comprising an outer cap provided with a top portion and a skirt portion having an internal wall, and an insert made of a plastic material having a threaded skirt fixed to the internal wall of the skirt of said outer cap, the skirt of said outer cap extending beyond the skirt of said insert, said threaded skirt comprising an inner thread for fixing the cap to the threaded neck of the bottle, the inner thread having a top portion and a bottom portion, the bottom portion of the thread having a thickness between 0.40 mm and 0.150 mm, the top portion has a thickness such that a ratio between the thickness of the thread at its top portion and its bottom portion is between 2 and 10, wherein the plastic material has mechanical properties equal at least to the mechanical properties of polyethylene at 25°C.

2. Cap according to claim 1, wherein the thickness of the bottom portion of the thread is between 0.25 mm and 0.20 mm.

3. Cap according to claim 1, wherein the skirt of the insert has a height between 10 mm and 20 mm.

4. Cap according to claim 3, wherein the height of the skirt of the insert is between 12 and 14 mm, the thickness of the bottom of the thread of the skirt is between 0.20 and 0.30 mm, and the weight of the insert is between 0.8 and 1.5 g.

5. Cap according to claim 1, wherein the skirt of the insert is fixed to the skirt of the outer cap by gluing, by force fitting or by heat sealing.

6. Cap according to claim 1, wherein insert comprises a top portion provided with an inner lip to make the cap leak tight.

7. Cap according to claim 1, additionally comprising an added seal to make the cap leak tight.

8. Cap according to claim 5, wherein the gluing is achieved either by using an adhesive layer forming the bond between the insert and the outer cap, or by providing a bondable layer on the inner wall of the skirt of the outer cap.

9. Cap according to claim 1, wherein the outer cap is selected from the group consisting of metallic caps, metalloplastic outer caps made of a multi-layer material and outer caps formed by stamping or rolling the corresponding material in a strip with a thickness of between 100 and 300 μm.

10. Cap according to claim 1, wherein the insert is formed from an injection molded plastic material that is suitable for contact with food.

11. Cap according to claim 10, wherein the plastic material is a polyolefin comprising a mineral filler for increasing the mechanical properties of the plastic material.

12. Cap according to claim 11, wherein the mineral filler is present in the plastic material content in an amount of 5 to 50% by weight.

13. Cap according to claim 12, wherein the plastic material is polypropylene and the mineral filler is present in an amount of between 35 and 45% by weight.

14. Cap according to claim 13, wherein the mineral filler is talc.

15. Cap according to claim 1, comprising at least one of:

means for preventing refill with an ad hoc device that can be removed or pre-assembled to the cap, to be inserted in the neck when the cap is being fitted; and anti-run means, with an anti-drip spout that can be removed or pre-assembled to the cap to be inserted in the neck when the cap is being fitted.

16. Manufacturing process for a cap according to claim 1, comprising the steps of:

a) supplying the outer caps;

b) forming the inserts by molding;

c) assembling the inserts within the outer caps to form the caps; and d) optionally adding other elements.

* * * * *